US009332786B2

(12) United States Patent
Yokogawa et al.

(10) Patent No.: US 9,332,786 B2
(45) Date of Patent: May 10, 2016

(54) CIGARETTE FILTER AND CAPSULE FILTER CIGARETTE USING SAME

(75) Inventors: Susumu Yokogawa, Tokyo (JP); Katsuo Kato, Tokyo (JP); Tetsuya Motodamari, Tokyo (JP); Hirokazu Masai, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 916 days.

(21) Appl. No.: 13/606,895

(22) Filed: Sep. 7, 2012

(65) Prior Publication Data

US 2012/0325232 A1 Dec. 27, 2012

Related U.S. Application Data

(63) Continuation of application No. PCT/JP2010/055231, filed on Mar. 25, 2010.

(51) Int. Cl.

| | |
|---|---|
| ***A24D 1/02*** | (2006.01) |
| ***A24D 3/06*** | (2006.01) |
| ***A24D 3/02*** | (2006.01) |

(52) U.S. Cl.

CPC *A24D 3/061* (2013.01); *A24D 1/02* (2013.01); *A24D 3/0287* (2013.01)

(58) Field of Classification Search

USPC ..... 131/200, 331, 337, 341, 343; 493/39, 493/50

See application file for complete search history.

(56) References Cited

U.S. PATENT DOCUMENTS

| | | | | |
|---|---|---|---|---|
| 7,878,962 | B2 * | 2/2011 | Karles | A24D 3/0216 131/337 |
| 2010/0108081 | A1 * | 5/2010 | Blevins Joyce | A24B 15/282 131/274 |
| 2012/0017926 | A1 * | 1/2012 | Karles | A24D 3/0216 131/337 |

FOREIGN PATENT DOCUMENTS

| | | | |
|---|---|---|---|
| CN | 101193564 | A | 6/2008 |
| CN | 101203148 | A | 6/2008 |
| GB | 420464 | A | 12/1934 |
| JP | 08-322538 | A | 12/1996 |
| JP | 2007-507230 | A | 3/2007 |
| JP | 2008-528053 | A | 7/2008 |
| JP | 2008-539717 | A | 11/2008 |
| JP | 2009-504175 | A | 2/2009 |
| KR | 10-2008-0003908 | A | 1/2008 |
| WO | WO 2005/032287 | A2 | 4/2005 |
| WO | WO 2006/082529 | A2 | 8/2006 |
| WO | WO 2006/117697 | A1 | 11/2006 |
| WO | WO 2007/060543 | A2 | 5/2007 |

* cited by examiner

*Primary Examiner* — Dennis Cordray

(74) *Attorney, Agent, or Firm* — Birch, Stewart, Kolasch & Birch, LLP

(57) ABSTRACT

There are provided with a plurality of filter materials (2) spaced out in a line and whose filter fiber is exposed on the surface thereof; a capsule (3) arranged between the filter materials (2) and in which content liquid to be used as a flavoring agent or adsorbent is enclosed; shaping paper (4) that covers the filter materials (2) and the capsule (3), connects the filter materials (2) to each other, and includes permeation-preventing material for preventing the permeation of the content liquid; and an adhesion device (5) for adhering the filter materials (2) and the shaping paper (4) to each other in between the filter materials (2) and the shaping paper (4) over the entire circumference of the filter materials (2) and the shaping paper (4).

8 Claims, 6 Drawing Sheets

FIG. 8

| | SHAPING PAPER | ROLLING PAPER | PERMEATION TO TIPPING PAPER | PERMEATION TO WRAPPING PAPER |
|---|---|---|---|---|
| COMPARATIVE EXAMPLE 1 | YES | YES | YES | YES |
| COMPARATIVE EXAMPLE 2 | YES (OIL-PROOF PAPER) | YES | NO | YES |
| COMPARATIVE EXAMPLE 3 | YES (OIL-PROOF PAPER) | YES (OIL-PROOF PAPER) | NO | YES |
| COMPARATIVE EXAMPLE 4 | YES (OIL-PROOF PAPER) | NO | NO | YES |
| EMBODIMENT | WAX | NO | NO | NO |

CIGARETTE FILTER AND CAPSULE FILTER CIGARETTE USING SAME

This application is a Continuation of PCT Application No. PCT/JP2010/055231 filed on Mar. 25, 2010. The entire contents are hereby incorporated by reference into the present application.

TECHNICAL FIELD

The present invention relates to a cigarette filter provided in its cavity with a capsule capable of being broken with fingers, and a capsule filter cigarette using the same.

BACKGROUND ART

A capsule filter cigarette is widely known, in which a capsule is situated in a cavity formed in a cigarette filter. The cavity is formed, for example, between filter segments created by dividing the filter. This capsule filter cigarette is designed so that a flavoring agent or adsorbent enclosed in the capsule works when the capsule is broken at the time of smoking. If the flavoring agent or adsorbent is liquid, after the capsule is broken with fingers, the content liquid of the capsule permeates the tipping paper covering the cigarette filter. This causes the problem that the content liquid adheres to the fingers holding the tipping paper. Another problem is that, if the content liquid permeates as far as the wrapping paper that covers shred tobacco, cigarette flammability is degraded. Furthermore, if the content liquid that has permeated the wrapping paper is inflamed, this affects the taste and flavor of the cigarette.

The cigarette filter is made by the steps of wrapping filter fiber in rolling paper and thus producing a filter segment, and wrapping the filter segment in shaping paper (wrapping the whole of each filter segment if there are plural filter segments or wrapping all filter segments and capsules together if capsules are arranged in cavities between the filter segments). If the shaping paper is made of permeation-preventing material such as oil-proof material, it is possible to prevent the event in which the content liquid permeates the tipping paper. Instead, however, there will be another problem that the content liquid permeates the rolling paper located on the inner side of the shaping paper and continues to permeate as far as the wrapping paper.

The inventors of the present invention carried out a review of the foregoing problem and replaced the rolling paper with the one made of permeation-preventing material such as oil-proof paper. In the result, it was newly found that the content liquid flowed through a gap between the rolling paper and the shaping paper, and between the rolling paper and filter fiber, and permeated the wrapping paper. Upon further review, the inventors utilized, as a filter segment, NWA (Non Wrapped Acetate) without rolling paper. Again, the content liquid flowed through the gap between the NWA filter fiber and the shaping paper and ended up permeating the wrapping paper. The inventors thus recognized that the above-mentioned way was inadequate for solving the problem.

In respect of the same problem, Patent Document 1 discloses a cigarette filter in which a capsule containing fluid material is placed in an area sandwiched between filter segments. This cigarette filter has an outer cover made of material that is virtually impervious to the fluid material enclosed in the capsule, and thus covers the capsule in this outer cover. In short, impervious material (cellophane, polyvinylidene chloride or virtually impervious film or sheet) is used to prevent the permeation of the content liquid enclosed in the capsule. However, if the impervious material mentioned in Patent Document 1 is used, there is the possibility to adversely affect the wrapping of filter fiber and the capsule. Since it is assumed that the impervious material mentioned in Patent Document 1 is not air-permeable, the material is not capable of taking in air for attenuation into the cigarette filter. This can cause a disadvantage in light of the product design of the cigarette. One way to take in air for attenuation into the cigarette filter is to use laser perforation. Considering factory health and safety, however, it is not preferable to use laser, for example, to perforate cellophane.

There is another well-known capsule filter cigarette, in which a capsule is embedded in filter fiber instead of being inserted in a cavity so that the content liquid of the capsule is adsorbed by the filter fiber. This cigarette makes it a little difficult to squash the capsule with fingers together with the filter fiber. It is also difficult to embed the capsule in a certain place of the filter fiber.

PRIOR ART DOCUMENT

Patent Document

Japanese Unexamined Patent Application Publication (Kohyo) No. 2008-539717

SUMMARY OF THE INVENTION

Problems to be Solved by the Invention

The present invention has been made in light of the foregoing conventional technology. It is an object of the invention to provide a cigarette filter that is designed to improve the quality of a capsule filter cigarette by preventing the content liquid of a capsule from permeating outside the cigarette filter after the capsule is broken and thus from adhering to fingers, wetting wrapping paper, etc., and a capsule filter cigarette using the cigarette filter.

Means for Solving the Problems

In order to achieve the object, the invention provides a cigarette filter having a plurality of filter materials spaced out in a line; a capsule arranged between the filter materials and in which content liquid to be used as a flavoring agent or adsorbent is enclosed; shaping paper that covers the filter materials and the capsules, connects the filter materials to each other, and includes permeation-preventing material for preventing the permeation of the content liquid; and an adhesion device for adhering the filter materials and the shaping paper to each other in between the filter materials and the shaping paper over a part of or the entire circumference of the filter materials and the shaping paper. Among the filter materials, the filter material situated nearer a tobacco rod filled with shred tobacco in relation to the capsule is a non-wrapped filter segment whose filter fiber is exposed on a surface thereof.

The shaping paper is water-proof paper with water resistance, oil-proof paper with oil resistance, or water- and oil-proof paper with water and oil resistance.

The permeation-preventing material is water or oil-proof wax applied to the entire area, which is tightly attached to the filter materials.

The adhesion device is a gap-filling layer for filling a gap between the shaping paper and the non-wrapped filter segment.

The adhesion device is an adhesive agent with an adherence property.

There is provided a capsule filter cigarette that is formed of the cigarette filter of the present invention and a tobacco rod connected to the cigarette filter with tipping paper intervening therebetween.

Advantages of the Invention

According to the invention, the shaping paper prevents the permeation of the content liquid enclosed in the capsule. When used as a capsule filter cigarette in the future, the invention can prevent the content liquid from transuding to the tipping paper. Since the adhesion device is situated between the filter materials and the shaping paper, the content liquid enclosed in the capsule does not permeate between the filter materials and the shaping paper. When used as a capsule filter cigarette in the future, the invention can prevent the content liquid from transuding to the wrapping paper of the tobacco rod.

Being water-proof paper with water resistance, oil-proof paper with oil resistance or water and oil-proof paper with water and oil resistance, the shaping paper prevents the permeation of the liquid that is the content liquid enclosed in the capsule. Accordingly, when used as a capsule filter cigarette in the future, the invention can prevent the content liquid from transuding to the tipping paper.

Furthermore, the permeation-preventing material is the water or oil-proof wax applied to the entire area, which is tightly attached to the filter materials. This reliably prevents the liquid that is the content liquid enclosed in the capsule from permeating the shaping paper and also prevents the content liquid from permeating between the filter materials and the shaping paper. When used as a capsule filter cigarette in the future, the invention can prevent the content liquid not only from transuding to the tipping paper but also from transuding to the wrapping paper of the tobacco rod.

Since the adhesion device is the gap-filling layer that fills the gap between the shaping paper and the non-wrapped filter segment, the non-wrapped filter segment and the shaping paper are firmly attached to each other with the gap-filling layer intervening therebetween. This makes it possible to reliably prevent the content liquid enclosed in the capsule from permeating between the non-wrapped filter segment and the shaping paper. When used as a capsule filter cigarette in the future, the invention can prevent the content liquid from transuding to the wrapping paper of the tobacco rod.

Since the adhesion device is the adhesive agent with an adherence property, the filter materials and the shaping paper can be firmly attached together by filling the gap therebetween with the adhesive agent. This makes it possible to reliably prevent the content liquid enclosed in the capsule from permeating between the filter materials and the shaping paper. When used as a capsule filter cigarette in the future, the invention can prevent the content liquid from transuding to the wrapping paper of the tobacco rod.

A capsule filter cigarette having the advantages of the invention can also be obtained. It is then possible to prevent the content liquid enclosed in the capsule from adhering to fingers or permeating the wrapping paper after the capsule is broken, thereby improving the quality of the capsule filter cigarette.

BRIEF DESCRIPTION OF THE DRAWINGS

FIG. 8 shows experiment data on an embodiment of the invention and comparative examples.

BEST MODE FOR CARRYING OUT THE INVENTION

Figure 1:
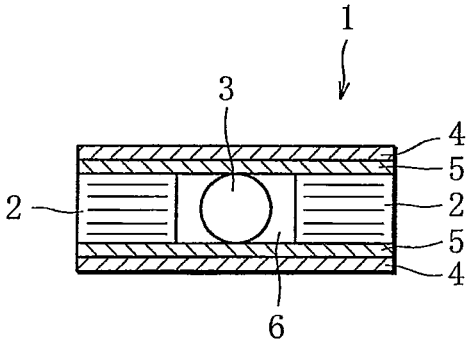
FIG. 1 is a schematic cross-sectional view of a cigarette filter according to the invention.

As shown in FIG. 1, a cigarette filter 1 of the invention is formed of a plurality of (two in the drawing) filter materials 2, a capsule 3, shaping paper 4 and an adhesion device 5. The filter materials 2 are spaced out in a line. Formed between the filter materials 2 is a cavity 6, in which the capsule 3 is situated. The capsule 3 encloses a flavoring agent or adsorbent in a liquid form. The flavoring agent may be, for example, aroma chemical such as menthol or the like. The adsorbent may be, for example, hydrotalcite or the like. The capsule 3 is made, for example, of gelatin. When the capsule 3 is squashed, the flavoring agent or adsorbent, namely, the content liquid of the capsule 3 is released. The filter materials 2 and the capsule 3 are wrapped in a sheet of shaping paper 4. Between the filter materials 2 and the shaping paper 4, there is disposed the adhesion device 5 for firmly attaching the filter materials 2 and the shaping paper 4 together. The adhesion device 5 will be described below in detail.

The filter materials 2 include filter fiber (tow) exposed on the surface thereof. More specifically, the filter materials 2 are made by hot-forming the filter fiber into a solid column without using rolling paper. In short, the filter materials 2 are made of the NWA mentioned above. The shaping paper 4 includes permeation-preventing material for preventing the permeation of the content liquid enclosed in the capsule 3. How to provide the permeation-preventing material to the shaping paper 4 will be described below in detail.

Figure 5:
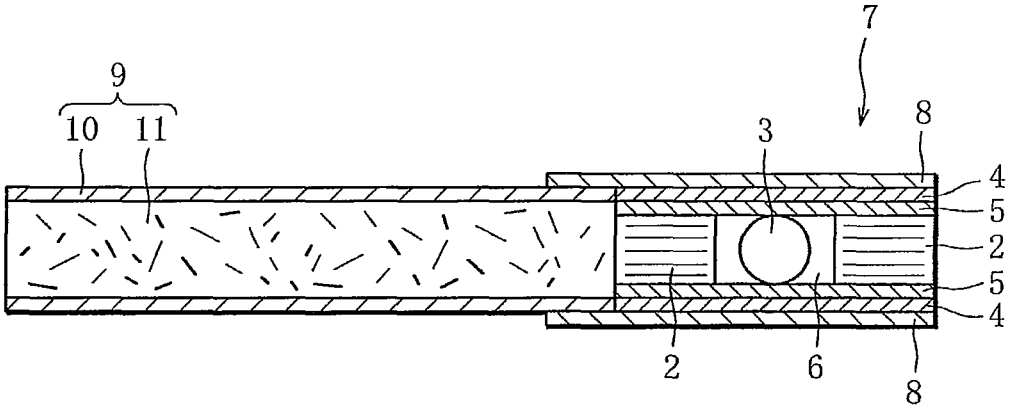
FIG. 5 is a schematic cross-sectional view of a capsule filter cigarette according to the invention.

Due to the foregoing configuration, the shaping paper 4 prevents the permeation of the content liquid enclosed in the capsule 3. When this configuration is applied to a capsule filter cigarette 7 (FIG. 5) in the future, the content liquid can be prevented from transuding to tipping paper 8 (FIG. 5). Since the adhesion device 5 is situated between the filter materials 2 and the shaping paper 4, the content liquid enclosed in the capsule 3 does not permeate between the filter materials 2 and the shaping paper 4. When the above configuration is applied to the capsule filter cigarette 7 in the future, the content liquid can be prevented from transuding to wrapping paper (FIG. 5) of a tobacco rod 9 (FIG. 5).

In order to reliably prevent the content liquid from permeating through the shaping paper 4, the shaping paper 4 may be water-proof paper with water resistance, oil-proof paper with oil resistance or water and oil-proof paper with water and oil resistance. That is to say, the shaping paper 4 is made of permeation-preventing material with water and oil resistance. This way, the liquid that is the content liquid enclosed in the capsule 3 can be reliably prevented from permeating the shaping paper 4. Another way is to modify the property of the surface of the shaping paper 4 to provide oil or water resistance.

Figure 2:
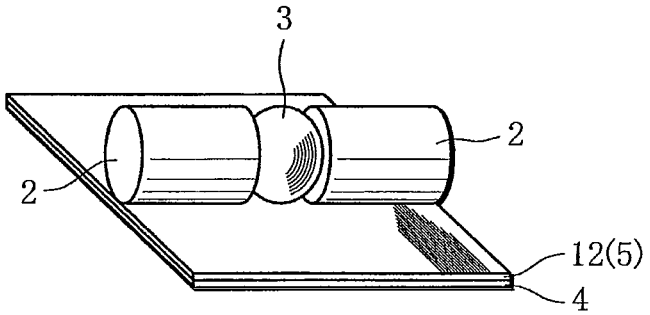
FIG. 2 is a schematic exploded perspective view of the cigarette filter according to the invention.

As shown in FIG. 2, the permeation-preventing material may be wax 12 having water or oil resistance. In this case, the wax 12 is applied to the entire area where the shaping paper 4 and the filter materials 2 are firmly attached together. At the time of wrapping the shaping paper 4, the wax 12 is melted. This way, the liquid that is the content liquid enclosed in the capsule 3 can be reliably prevented from permeating the shaping paper 4. The wax 12 can also be used as the adhesion device 5 between the filter materials 2 and the shaping paper 4, and thus prevents the content liquid from permeating between the filter materials 2 and the shaping paper 4. In this view, when used as the capsule filter cigarette 7 in the future, the invention can prevent the content liquid not only from transuding to the tipping paper 8 but also from transuding to the wrapping paper 10 of the tobacco rod 9. The wax 12 improves efficiency as it prevents both the permeation of the content liquid passing through the shaping paper 4 and the permeation of the content liquid running down the inner side of the shaping paper 4.

Figure 3:
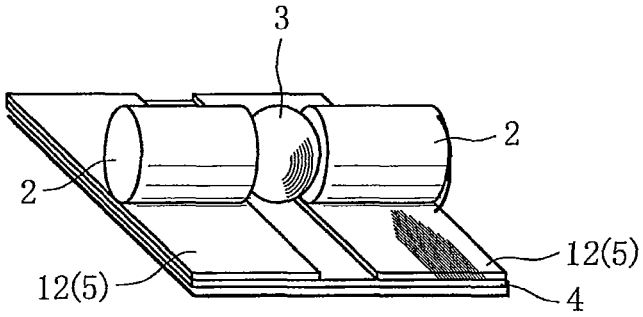
FIG. 3 is a schematic exploded perspective view of another cigarette filter according to the invention.

As another form of the adhesion device 5, a gap-filling layer may be formed between the shaping paper 4 and the filter materials 2 as shown in FIG. 3. The gap-filing layer is formed in an area expanding over the half or more of the circumference of the filter materials 2, or preferably, over the entire circumference of the filter materials 2. The filter materials 2 and the shaping paper 4 are thus firmly attached together with the gap-filling layer intervening therebetween. This makes it possible to reliably prevent the content liquid enclosed in the capsule 3 from permeating between the filter materials 2 and the shaping paper 4. The wax 12 may be used as the gap-filling layer. In this case, water and oil-proof paper is used as the shaping paper 4, to thereby prevent the content liquid from permeating through the shaping paper 4.

Figure 4:
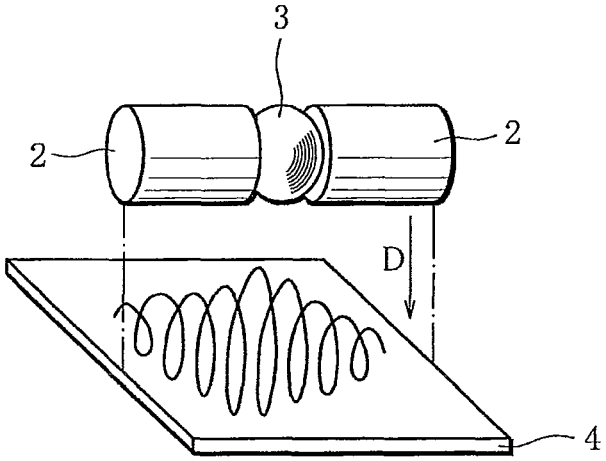
FIG. 4 is a schematic exploded perspective view of still another cigarette filter according to the invention.

As the adhesion device, an adhesive agent with an adherence property may be used. In this case, as shown in FIG. 4, the adhesive agent is applied to an adherend side of the shaping paper 4 in circles. The filter materials 2 and the capsule 3 are shifted in a direction of arrow D until contacting the shaping paper 4, and then wrapped in the shaping paper 4. Since the gap between the filter materials 2 and the shaping paper 4 is filled with the adhesive agent, the filter materials 2 and the shaping paper 4 can be firmly attached together. This makes it possible to reliably prevent the content liquid enclosed in the capsule 3 from permeating between the filter materials 2 and the shaping paper 4. As the adhesive agent, glue, hot-melt adhesive or the like may be used. In addition, the adhesive agent does not have to be applied in circles.

FIG. 5 is a schematic cross-sectional view of a capsule filter cigarette using the cigarette filter described above. The capsule filter cigarette 7 is formed of the cigarette filter 1, the tobacco rod 9 and the tipping paper 8. The tobacco rod 9 and the cigarette filter 1 are connected together with the tipping paper 8 intervening therebetween. The tipping paper 8 is wrapped around the entire circumference of the cigarette filter 1. At the same time, the tipping paper 8 is wrapped around and thus holds an end portion of the tobacco rod 9. The tobacco rod 9 is formed of shred tobacco 11 and wrapping paper 10 that covers the shred tobacco 11. It is then possible to prevent the content liquid enclosed in the capsule 3 from adhering to fingers or permeating the wrapping paper 10 after the capsule 3 is broken, thereby improving the quality of the capsule filter cigarette 7.

Figure 6:
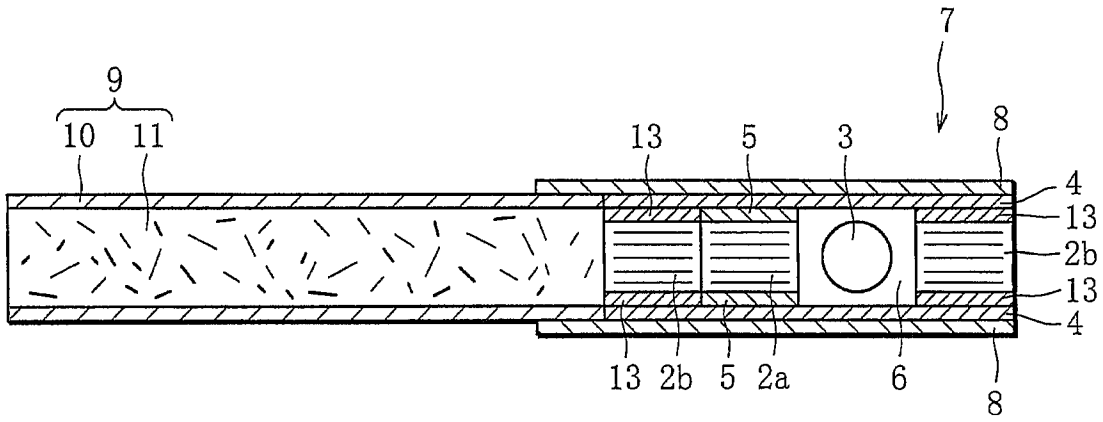
FIG. 6 is a schematic cross-sectional view of another capsule filter cigarette according to the invention.
Figure 7:
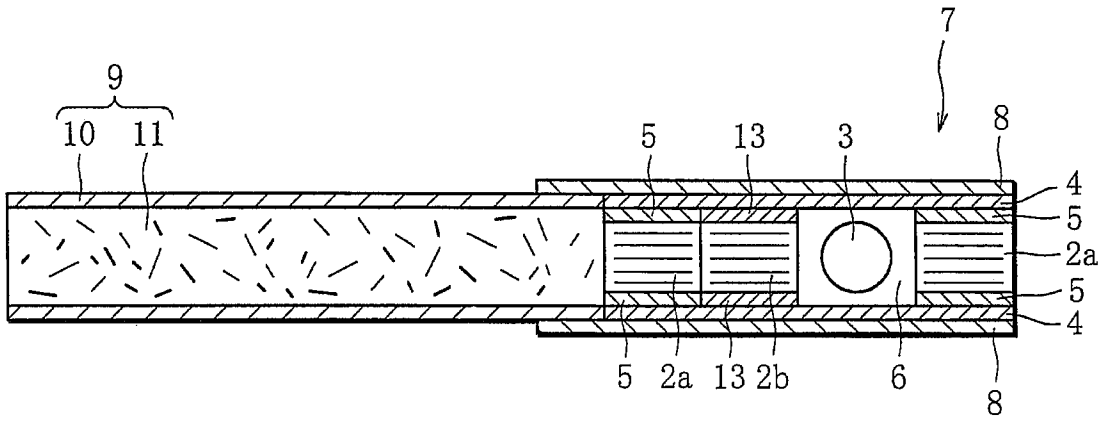
FIG. 7 is a schematic cross-sectional view of still another capsule filter cigarette according to the invention.

The above-mentioned embodiments refer to the filter materials 2 that are all made of NWA, namely, non-wrapped filter segments that are not wrapped in rolling paper. As shown in FIG. 6 or 7, however, plane filter segments 2*b* wrapped in rolling paper 13, which are commonly used as filter materials, may be combined with the non-wrapped filter segments. In this case, a non-wrapped filter segment 2*a* should be situated nearer the tobacco rod 9 in relation to the capsule 3. If the non-wrapped filter segment 2*a* is used as the filter material situated nearer the tobacco rod 9 in relation to at least the capsule 3 as stated above, the content liquid enclosed in the capsule 3 is prevented from adhering to fingers and permeating the wrapping paper 10. The examples shown in FIGS. 6 and 7 are triple filters formed of three filter segments including the plane filter segments 2*b* and the non-wrapped filter segment 2*a*. The filter shown in FIG. 6 is formed of one non-wrapped filter segment 2*a* and two plane filter segments 2*b*. The filter shown in FIG. 7 is formed of two non-wrapped filter segments 2*a* and one plane filter segment 2*b*. In these examples, the non-wrapped filter segments 2*a* are situated nearer the tobacco rod 9 in relation to the capsule 3. As long as wrapped in the rolling paper 13, the plane filter segments 2*b* may be made of any kind of material such as charcoal filter segments.

FIG. 8 is experiment data on the embodiment of the invention and comparative examples.

According to Comparative Example 1, in which commonly-used shaping paper and rolling paper were used, the content liquid permeated through the shaping paper when the capsule was squashed with fingers. Under the column "Permeation to the tipping paper" on Comparative Example 1, therefore, the result reads "YES". The result under permeation to the wrapping paper is "YES" as well because the content liquid permeated between the shaping paper and the rolling paper. Whether the content liquid transuded as a result of permeation was visually judged (the same applies below). As shown in Comparative Example 2, the paper used as shaping paper was replaced with oil-proof paper. As the result, due to the properties of oil-proof paper, the content liquid was prevented from permeating through the shaping paper. Consequently, there was no permeation of the content liquid to the tipping paper. On the other hand, the content liquid was not prevented from running down between the shaping paper and the rolling paper and from permeating the inside of the rolling paper. The result of permeation of the wrapping paper therefore remains "YES". As shown in Comparative Example 3, the rolling paper was replaced with oil-proof paper, too. The shaping paper was again oil-proof paper. However, there was a gap between the shaping paper and the rolling paper, and the content liquid permeated through the gap. The result of permeation to wrapping paper is "YES". To solve this, as shown in Comparative Example 4, the filter materials were replaced with those made of NWA, and the rolling paper was removed. The shaping paper was again oil-proof paper. However, the content liquid permeated through the gap between the shaping paper and the filter materials. The result of permeation to the wrapping paper therefore remains "YES".

The inventors then thought of applying wax onto the shaping paper and melting the result as shown in the embodiment. The filter materials were again NWA. The cigarette filter according to the embodiment shown in FIG. 2 was used to produce a capsule filter cigarette. When the capsule was squashed with fingers, the permeation to the tipping paper and that to the wrapping paper were both prevented. The inventors reached the same result in the above-described embodiment of the invention.

REFERENCE MARKS

1 Cigarette filter
2 Filter material
2*a* Non-wrapped filter segment
2*b* Plane filter segment

3 Capsule
4 Shaping paper
5 Adhesion device
6 Cavity
7 Capsule filter cigarette
8 Tipping paper
9 Tobacco rod
10 Wrapping paper
11 Shred tobacco
12 Wax
13 Rolling paper

The invention claimed is:

1. A cigarette filter to which a tobacco rod filled with shredded tobacco is connected, comprising:

a plurality of filter materials spaced out in a line, each filter material including filter fiber;

a capsule arranged between the filter materials and enclosing content liquid to be used as a flavoring agent or adsorbent;

shaping paper that covers the filter materials and the capsule and connects the filter materials to each other;

a permeation-preventing material applied to or impregnated into the shaping paper to prevent permeation of the content liquid into the shaping paper; and an adhesion device for firmly attaching the filter materials and the shaping paper to each other in between the filter materials and the shaping paper over a part of or the entire circumference of the filter materials and the shaping paper, wherein among the filter materials, at least one filter material situated nearer the tobacco rod in relation to the capsule is a non-wrapped filter segment whose filter fiber is exposed on a surface thereof, and wherein the permeation-preventing material is water-proof wax or oil-proof wax applied to the entire area wherein the shaping paper and the filter materials are firmly attached together.

2. The cigarette filter according to claim 1, wherein the shaping paper is water-proof paper with water resistance, oil-proof paper with oil resistance or water and oil-proof paper with water and oil resistance.

3. A cigarette filter to which a tobacco rod filled with shredded tobacco is connected, comprising:

a plurality of filter materials spaced out in a line, each filter material including filter fiber;

a capsule arranged between the filter materials and enclosing content liquid to be used as a flavoring agent or adsorbent;

shaping paper that covers the filter materials and the capsule and connects the filter materials to each other;

an adhesion device for firmly attaching the filter materials and the shaping paper to each other in between the filter materials and the shaping paper over a part of or the entire circumference of the filter materials and the shaping paper, wherein among the filter materials, at least one filter material situated nearer the tobacco rod in relation to the capsule is a non-wrapped filter segment whose filter fiber is exposed on a surface thereof, and wherein the adhesion device is a gap-filling layer for filling a gap between the shaping paper and the non-wrapped filter segment.

4. The cigarette filter according to claim 1, wherein the adhesion device is an adhesive agent with an adherence property.

5. A capsule filter cigarette comprising:

the cigarette filter claimed in claim 1, and tipping paper that covers an entire circumference of the cigarette filter and wraps an end portion of the tobacco rod together with the cigarette filter to hold the tobacco rod and the cigarette filter together.

6. The cigarette filter according to claim 3, wherein the shaping paper is water-proof paper with water resistance, oil-proof paper with oil resistance or water-proof and oil-proof paper with water and oil resistance.

7. The cigarette filter according to claim 3, wherein the adhesion device is an adhesive agent with an adherence property.

8. A capsule filter cigarette, comprising:

the cigarette filter claimed in claim 3; and tipping paper that covers an entire circumference of the cigarette filter and wraps an end portion of the tobacco rod together with the cigarette filter to hold the tobacco rod and the cigarette filter together.

* * * * *